US011248863B2

(12) United States Patent
Zukowski

(10) Patent No.: US 11,248,863 B2
(45) Date of Patent: Feb. 15, 2022

(54) BLOWBACK ACTION WITH GAS ASSIST

(71) Applicant: Smith & Wesson Inc., Springfield, MA (US)

(72) Inventor: Gary Zukowski, Ludlow, MA (US)

(73) Assignee: Smith & Wesson Inc., Springfield, MA (US)

( * ) Notice: Subject to any disclaimer, the term of this patent is extended or adjusted under 35 U.S.C. 154(b) by 0 days.

(21) Appl. No.: 17/194,355

(22) Filed: Mar. 8, 2021

(65) Prior Publication Data

US 2021/0372721 A1 Dec. 2, 2021

Related U.S. Application Data

(60) Provisional application No. 63/021,279, filed on May 7, 2020.

(51) Int. Cl.

| | |
|---|---|
| ***F41A 5/02*** | (2006.01) |
| ***F41A 5/24*** | (2006.01) |
| ***F41A 5/26*** | (2006.01) |
| ***F41A 5/14*** | (2006.01) |

(52) U.S. Cl.
CPC *F41A 5/02* (2013.01); *F41A 5/14* (2013.01); *F41A 5/24* (2013.01); *F41A 5/26* (2013.01)

(58) Field of Classification Search
CPC ..... F41A 3/62; F41A 5/02; F41A 5/14; F41A 5/24; F41A 5/26
USPC ..... 89/194–197
See application file for complete search history.

(56) References Cited

U.S. PATENT DOCUMENTS

| | | | | |
|---|---|---|---|---|
| 2,935,000 | A | 5/1960 | Mowrey | |
| 3,728,939 | A | 4/1973 | Wilhelm | |
| 3,736,839 | A | 6/1973 | Childers | |
| 4,028,994 | A * | 6/1977 | Ferluga | F41A 3/62 89/161 |
| 4,061,075 | A * | 12/1977 | Smith | F41A 5/16 89/132 |
| 4,976,184 | A | 12/1990 | Bunczk | |
| 5,123,329 | A | 6/1992 | Irwin | |
| 5,225,615 | A | 7/1993 | Talbot et al. | |
| 5,305,678 | A | 4/1994 | Talbot et al. | |
| 5,657,919 | A * | 8/1997 | Berry | B25C 1/143 227/10 |
| 5,753,846 | A | 5/1998 | Koon | |

(Continued)

FOREIGN PATENT DOCUMENTS

FR 2466740 4/1981

*Primary Examiner* — Bret Hayes
(74) *Attorney, Agent, or Firm* — John A. Chionchio, Esq.; Ballard Spahr LLP

(57) ABSTRACT

A firearm using blowback action has a barrel which is movably mounted within a shroud which is fixedly mounted on the firearm's frame. A gas space is formed between the barrel and the shroud by a difference between the inner diameter of the shroud and the outer diameter of the barrel. At least one gas port provides fluid communication between the bore of the barrel and the gas space. During firing of a cartridge, pressurized gas in the gas space applies a force to the barrel which moves relatively to the shroud away from the muzzle end of the firearm to engage a slide or bolt, helping to move it out of battery and extract the spent cartridge casing. Gas is vented to the atmosphere through a gas vent defined between the barrel and the shroud in fluid communication with the gas space.

21 Claims, 6 Drawing Sheets

(56) References Cited

U.S. PATENT DOCUMENTS

| | | | | |
|---|---|---|---|---|
| 5,939,659 | A * | 8/1999 | Dobbins | F41A 5/16 89/161 |
| 6,490,959 | B2 | 12/2002 | Lavin | |
| 6,964,220 | B1 | 11/2005 | Lavin | |
| 8,640,598 | B1 * | 2/2014 | Jackson | F41A 5/20 89/191.02 |
| 9,921,022 | B1 * | 3/2018 | Noyce Merino | F41A 21/36 |
| 2006/0027091 | A1 * | 2/2006 | Ratti | F41A 5/20 89/162 |
| 2016/0003566 | A1 * | 1/2016 | Gomirato | F41A 5/28 89/193 |
| 2018/0347926 | A1 * | 12/2018 | Lopatin | F41A 3/26 |

* cited by examiner

BLOWBACK ACTION WITH GAS ASSIST

CROSS REFERENCE TO RELATED APPLICATIONS

This application is based upon and claims benefit of priority to U.S. Provisional Application No. 63/021,279, filed May 7, 2020, which application is hereby incorporated by reference herein.

FIELD OF THE INVENTION

This invention relates to semiautomatic firearms having blowback actions.

BACKGROUND

Many modern semiautomatic pistols and rifles function via "blowback" operation. Blowback action relies on the mass of a firearm's slide or bolt, in addition to spring force from a return spring, to keep the firearm's action closed (in battery) long enough during the firing event so that the chamber pressure drops sufficiently to permit safe extraction and ejection of the spent cartridge casing. The mass of the slide or bolt and the spring force must be carefully matched to the cartridge energy to compensate for the rearward thrust of the cartridge generated by the chamber pressure during firing. Upon firing, the cartridge case becomes a piston contained within the chamber, and is driven back against the slide or bolt by the expanding propellant gases when the propellant charge is ignited. Too much slide mass and/or spring force compared with the available propellant energy will prevent the firearm from cycling as the action will remain closed (in battery) after firing. Too little slide mass and/or spring force can allow the firearm to cycle too rapidly, with the action opening before the chamber pressure has dropped to a safe level. This poses a safety hazard, as the casing may rupture if not fully contained within the chamber while the propellant gas pressure is high.

In some cartridges, typically with long, straight-walled cases, there can be significant friction between the outside surface of the casing and the inside surface of the chamber during firing as the casing expands in response to the high propellant gas pressure. These friction forces are proportional to the pressure within the cartridge during firing, as well as the surface finish, and materials of the cartridge casing and chamber. In some cases, this friction force alone can exceed the rearward thrust available to cycle the action, preventing the spent casing from being extracted and ejected from the firearm and resulting in a malfunction. There is clearly an opportunity to address the challenges posed by friction between cartridge case and chamber as they affect the reliability of blowback operation.

SUMMARY

The invention concerns a firearm. In an example embodiment the firearm comprises a frame. A slide is mounted on the frame and is movable relatively thereto along a line of action into and out of battery. A shroud is fixedly mounted on the frame between the slide and the frame. A forward stop surface is fixedly mounted relatively to the frame. A rearward stop surface is fixedly mounted relatively to the frame. A barrel is mounted within the shroud. The barrel has a breech end and a muzzle end and defines a bore extending therebetween. The barrel is movable relative to the shroud along the line of action between a forward position and a rearward position. A forward engagement surface is mounted on the barrel. The forward engagement surface is engageable with the forward stop surface when the barrel is in the forward position. A rearward engagement surface is mounted on the barrel. The rearward engagement surface is engageable with the rearward stop surface when the barrel is in the rearward position. A gas space is defined between the shroud and the barrel. A thrust surface is positioned on the barrel and is oriented transversely to the line of action. The thrust surface faces the gas space. A reaction surface positioned on the shroud is oriented transversely to the line of action and faces the gas space. At least one gas port within the barrel extends between the bore and the gas space.

In an example embodiment the forward stop surface is positioned on the shroud. Further by way of example the rearward stop surface is positioned on the frame. Also by example the forward engagement surface may be positioned proximate the breech end of the barrel and the rearward engagement surface may be positioned proximate the breech end of the barrel.

In an example embodiment a gas vent is positioned between the barrel and the shroud for discharging gas to atmosphere. The gas vent is in fluid communication with the gas space when the barrel is in the rearward position.

Further by way of example the shroud comprises an inner surface surrounding the barrel and the barrel comprises an outer surface facing the inner surface. In an example embodiment the inner and the outer surfaces are cylindrical.

In an example firearm according to the invention the barrel comprises a first portion positioned between the breech end and the muzzle end. The first portion has a first outer diameter. A second portion is positioned between the first portion and the muzzle end. The second portion has a second outer diameter smaller than the first outer diameter. The gas space is defined between the shroud and the second portion of the barrel.

In a specific example embodiment the thrust surface comprises a first annular surface positioned on the barrel between the first and second portions thereof. Similarly by way of example, the reaction surface comprises a second annular surface positioned on the shroud overlying the second portion of the barrel. Further by way of example the barrel comprises a third portion extending between the second portion and the muzzle end thereof. The third portion has a third outer diameter less than the second outer diameter and thereby defines a gas vent between the barrel and the shroud for discharging gas to atmosphere.

In an example embodiment the gas vent is in fluid communication with the gas space when the barrel is in the rearward position. An example firearm according to the invention may further comprise a first shoulder projecting from and extending around the barrel. The first shoulder is positioned proximate to the gas port and comprises the thrust surface in this example. By way of example a second shoulder may project from and extend around the barrel. The second shoulder is positioned in spaced relation to the first shoulder. The first shoulder is positioned between the second shoulder and the gas port. Further by way of example a plurality of second shoulders may project from and extend around the barrel. The second shoulders are positioned in spaced relation to one another and to the first shoulder. The first shoulder is positioned between the second shoulders and the gas port by way of example.

In an example embodiment a portion of the barrel between the gas port and the muzzle end has a first outer diameter and a second portion of the barrel between the first portion and the muzzle end has a second outer diameter less than the first portion and thereby defining a gas vent between the barrel and the shroud for discharging gas to atmosphere. In an example embodiment the gas vent is in fluid communication with the gas space when the barrel is in the rearward position. In a specific example embodiment a portion of the barrel proximate the muzzle end comprises a plurality of flat outer surfaces positioned circumferentially around the barrel. A further example barrel comprises a plurality of curved surfaces. Each curved surface is positioned between two of the flat surfaces. The curved surfaces is engageable with the shroud. In an example embodiment the firearm comprises a pistol.

DETAILED DESCRIPTION

Figure 1:
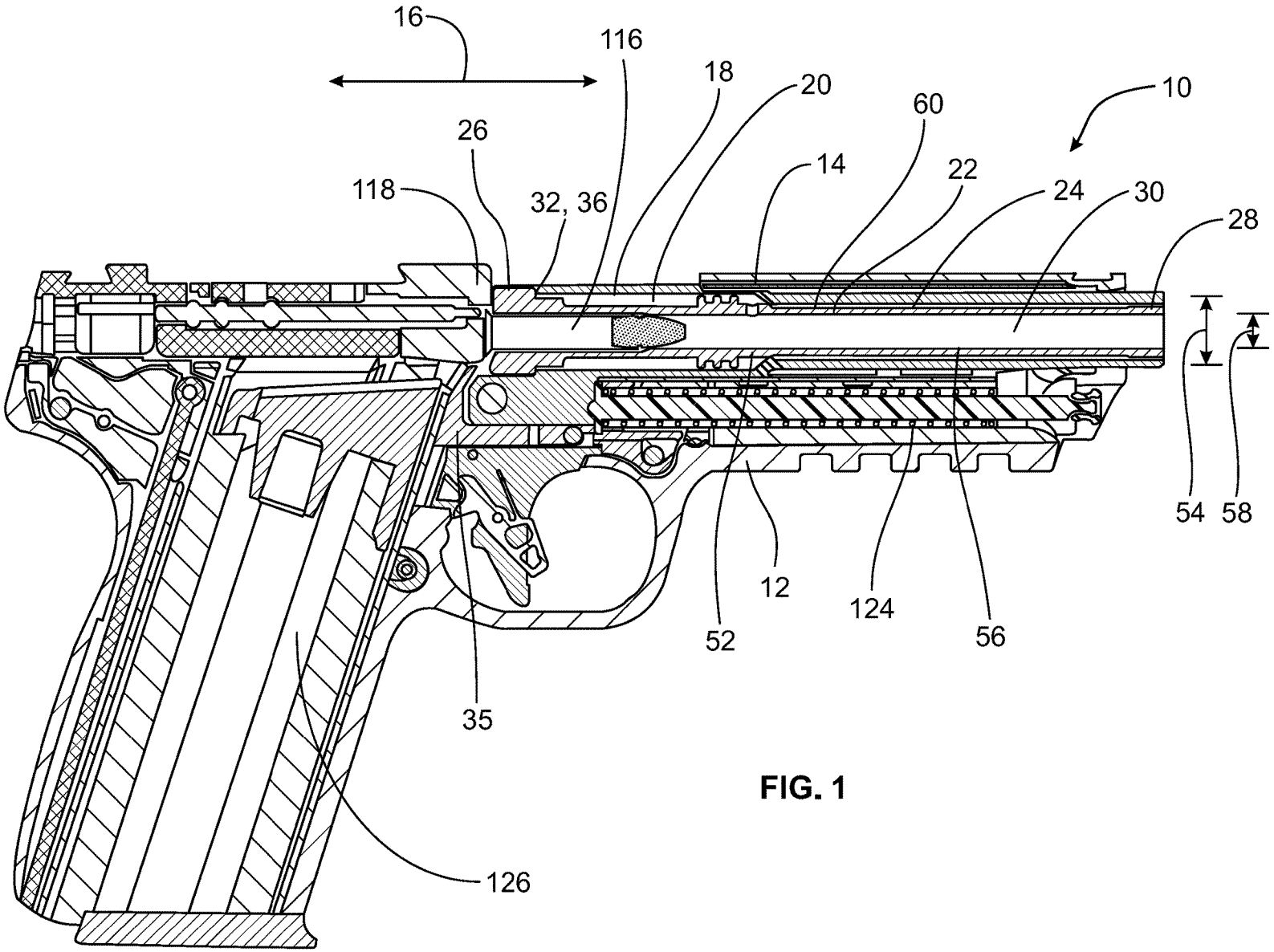
FIG. 1 is a sectional side view of an example firearm according to the invention.
Figure 2:
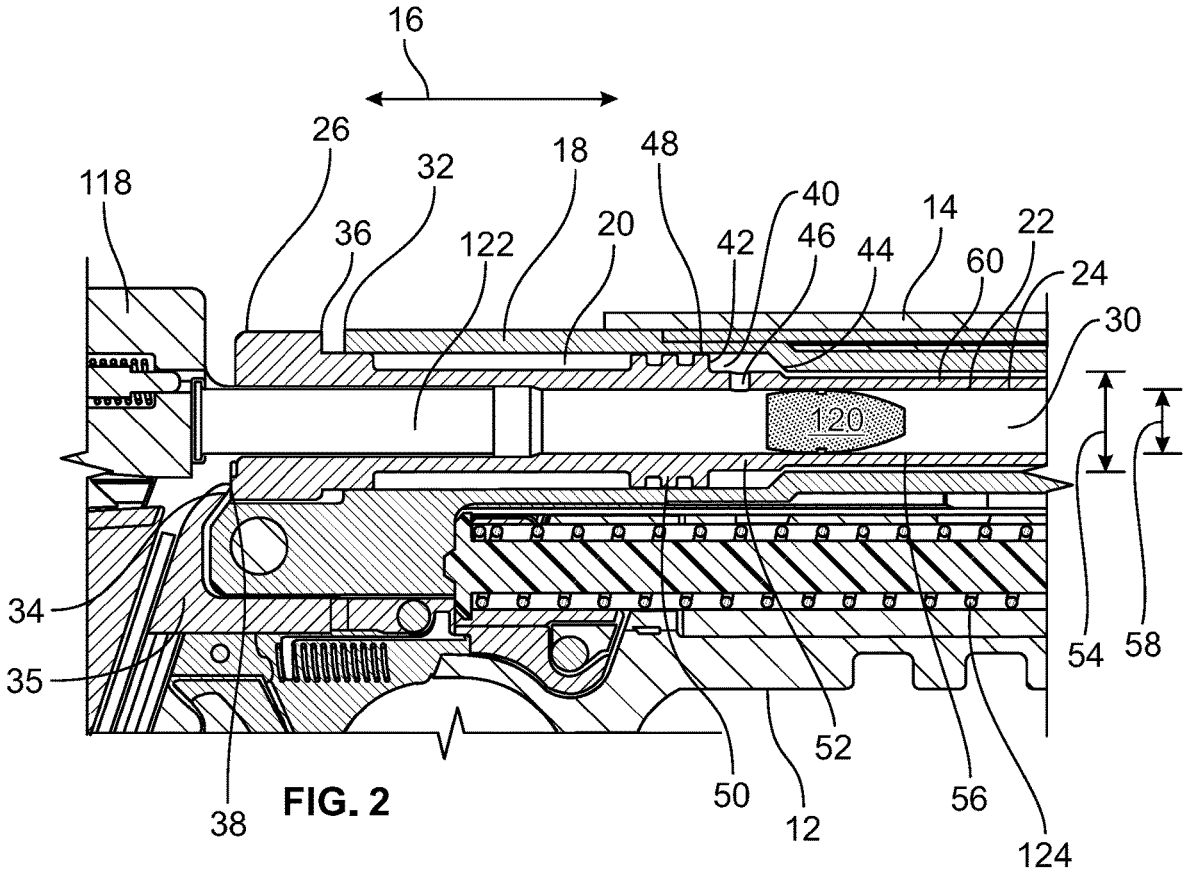
FIGS. 2 and 2A are sectional side views of a portion of the firearm shown in FIG. 1 on an enlarged scale.
Figure 2A:
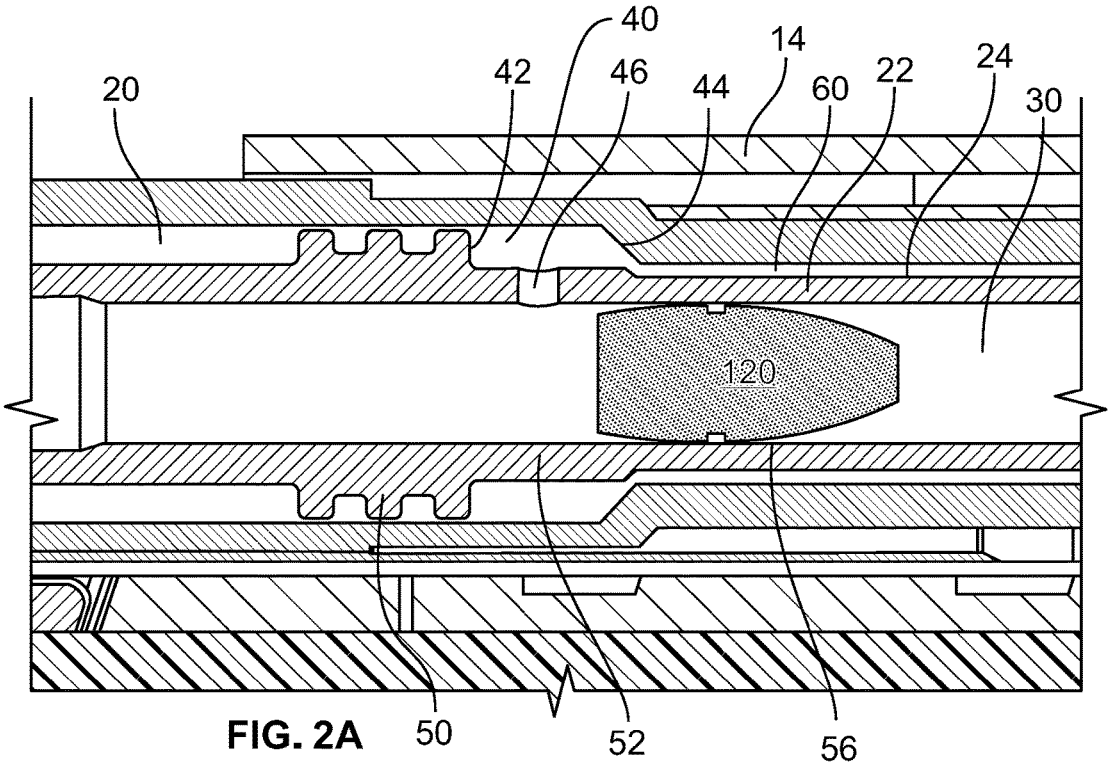

An example firearm 10 according to the invention is shown in FIG. 1. In this example firearm 10 is a semiautomatic pistol and comprises a frame 12. A slide 14 is mounted on the frame 12 and is movable relatively thereto along a line of action 16 into and out of battery. A shroud 18 is fixedly mounted on the frame between the slide 14 and the frame 12. In this example embodiment, a portion of shroud 18 is tubular and has a cylindrical inner surface 20. A barrel 22 is mounted within the shroud 18. Barrel 22 is also tubular and has a cylindrical outer surface 24 facing the inner surface 20 of shroud 18, the shroud's inner surface 20 surrounding the outer surface 24 of the barrel. Barrel 22 has a breech end 26 and a muzzle end 28 and defines a bore 30 extending therebetween. Barrel 22 is movable relative to the shroud 18 along the line of action 16 between a forward position shown in FIG. 1 and a rearward position shown in FIG. 2. Motion of barrel 22 along line of action 16 toward the muzzle end 28 is limited by a forward stop surface 32, fixedly mounted relatively to the frame 12. A rearward stop surface 34, also fixedly mounted relatively to the frame 12, limits the motion of barrel 22 away from the muzzle end 28. Both the forward and rearward stop surfaces may be directly or indirectly mounted on frame 12. In this example, the forward stop surface 32 is positioned on the shroud 18 and the rearward stop surface 34 is positioned on a locking block 35, thus both stop surfaces are mounted indirectly on frame 12. Motion of barrel 22 toward the muzzle end 28 is limited by engagement between the forward stop surface 32 and a forward engagement surface 36 mounted on the barrel 22. Engagement between the forward stop surface 32 and the forward engagement surface 36 signifies that barrel 22 is in the forward position. Similarly, motion of barrel 22 away from the muzzle end 28 is limited by engagement between the rearward stop surface 34 and a reward engagement surface 38 also mounted on the barrel 22. Engagement between the rearward stop surface 34 and the rearward engagement surface 38 signifies that barrel 22 is in the rearward position (FIG. 2). In the example firearm 10 both the forward engagement surface 36 and the rearward engagement surface 38 are positioned proximate the breech end 26 of the barrel 22.

As shown in FIG. 2, a gas space 40 is defined between the shroud 18 and the barrel 22. Gas space 40 is bordered by a thrust surface 42 positioned on the barrel 22 and a reaction surface 44 positioned on the shroud 18. Both the thrust surface 42 and the reaction surface 44 are oriented transversely to the line of action 16 and face the gas space 40. At least one gas port 46 extends through the barrel 22 between the bore 30 and the gas space 40. Gas port 46 provides fluid communication between the bore 30 and the gas space 40 for operation of the action as described below. In this example a single gas port 46 is shown, however, additional gas ports may also be used as required for a particular design.

In example firearm 10 the thrust surface 42 comprises a first shoulder 48 which projects from and extends around the barrel 22. The first shoulder 48 is positioned proximate to the gas port 46 and permits the barrel to act as a piston when high pressure gas enters the gas space. In this example a second shoulder 50 also projects from and extends around the barrel 22. Second shoulder 50 is positioned in spaced relation to the first shoulder 48, the first shoulder being positioned between the second shoulder and the gas port 46. Second shoulder helps to seal the gas space 40 and also supports barrel 22 within the shroud 18 and guides motion of the barrel relatively to the shroud. It is advantageous to provide a plurality of second shoulders 50 in spaced relation to one another and to the first shoulder to enhance the sealing, support and guiding functions of these elements. Diametric clearance between the shoulders 48 and 50 and the shroud 18 may range from 0.001 to 0.003 inches for a practical design.

Figure 4:
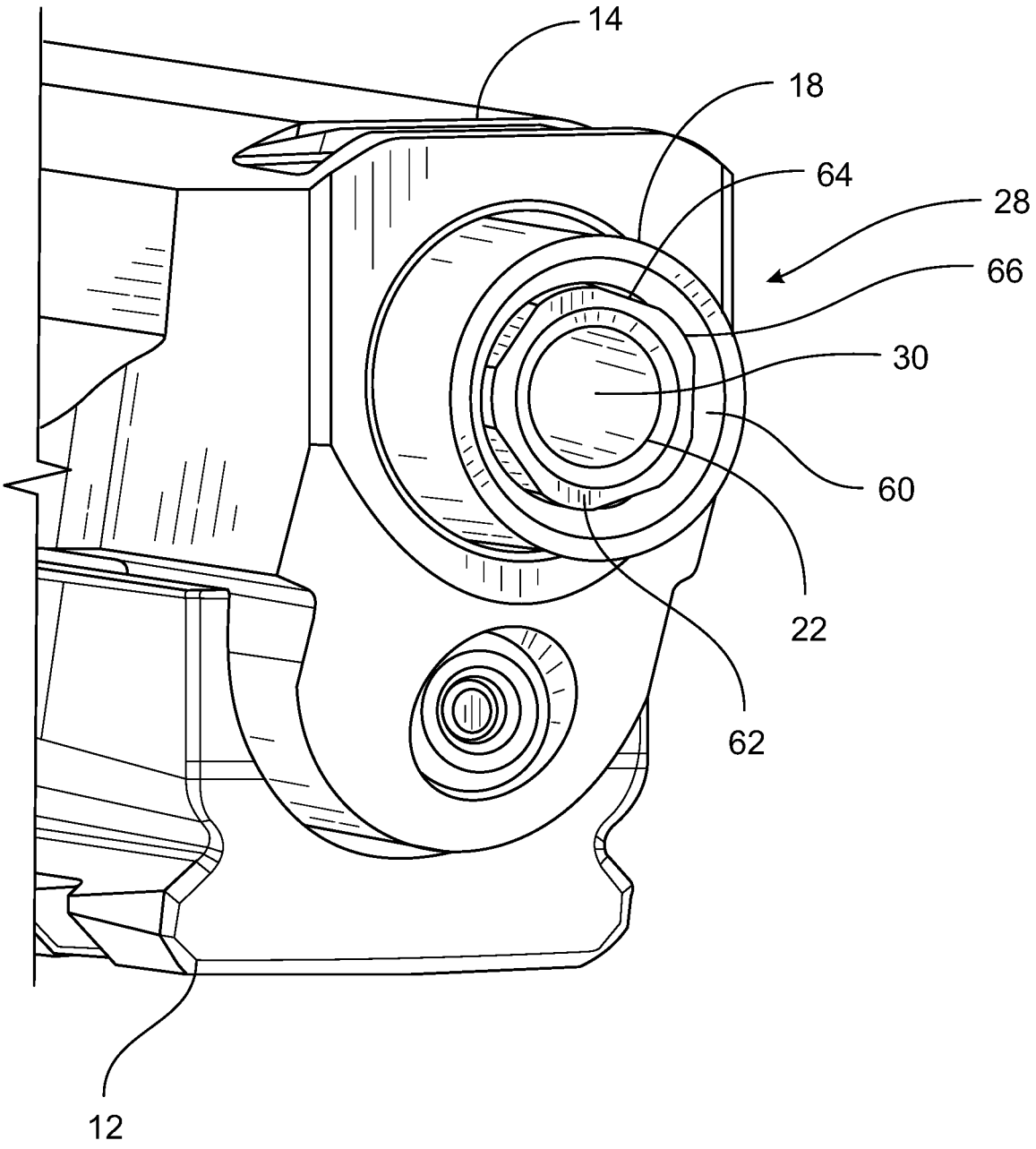
FIG. 4 is an isometric view of the muzzle end of the firearm shown in FIG. 1.

As further shown in FIGS. 1 and 2, a first portion 52 of the barrel 22 between the gas port 46 and the muzzle end 28 has a first outer diameter 54 and a second portion 56 of the barrel 22 between the first portion 52 and the muzzle end 28 has a second outer diameter 58 less than the first portion 52 and thereby defines a gas vent 60 between the barrel 22 and the shroud 18 for discharging gas to atmosphere at the muzzle end 28. A diametric clearance between the shroud 18 and the second outer diameter 58 of about 0.030 inches is expected to provide an effective gas vent 60 for a practical design. As shown in FIG. 2, the gas vent 60 is in fluid communication with the gas space 40 when the barrel 22 is in the rearward position. However, when barrel 22 is in the forward position the gas space 40 is sealed from the gas vent 60 by the first barrel portion 52 and shroud 18. A diametric clearance between diameter 54 and the shroud 18 from 0.001 to 0.003 inches is expected to provide an effective seal for a practical design. As shown in FIG. 4, a portion 62 of the barrel 22 proximate the muzzle end 28 comprises a plurality of flat outer surfaces 64. Flat outer surfaces 64 are positioned circumferentially around the barrel 22 and provide space between the barrel and the shroud 18 for gas venting. A plurality of curved surfaces 66 are positioned between the flat surfaces 64. Curved surfaces 66 are engageable with the shroud 18 to support and guide the muzzle end 28 of barrel 22 within the shroud.

Figure 5:
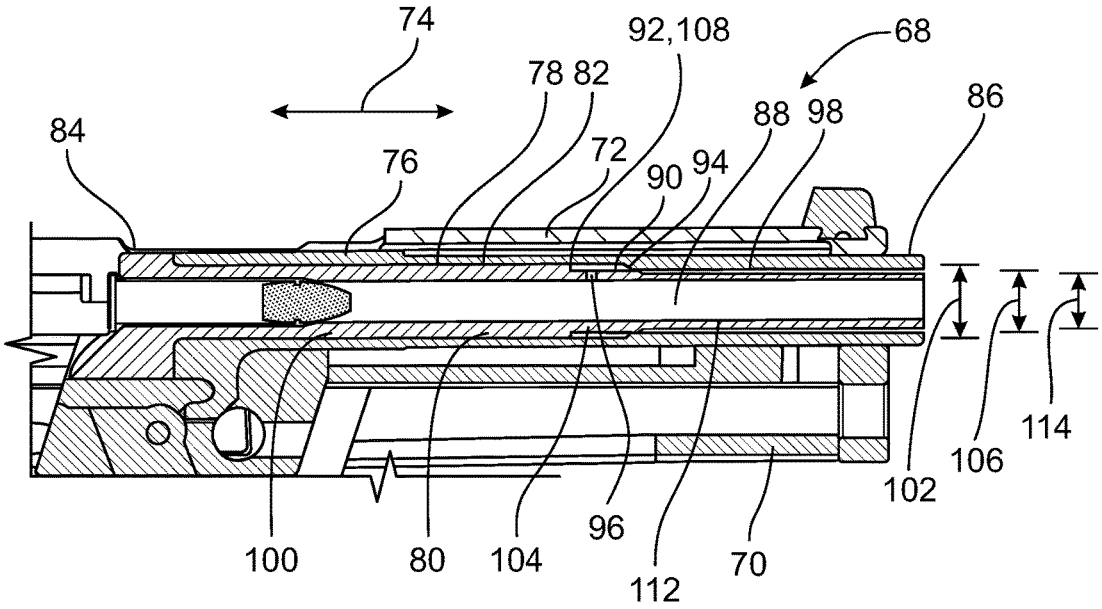
FIG. 5 is a partial sectional side view of another embodiment of a firearm according to the invention.

FIG. 5 illustrates another embodiment of a firearm 68 according to the invention. Firearm 68 is a semiautomatic pistol and comprises a frame 70. A slide 72 is mounted on the frame 70 and is movable relatively thereto along a line of action 74 into and out of battery. A shroud 76 is fixedly mounted on the frame between the slide 72 and the frame 70. In this example embodiment, shroud 76 is tubular and has a cylindrical inner surface 78. A barrel 80 is mounted within the shroud 76. Barrel 80 is also tubular and has a cylindrical outer surface 82 facing the inner surface 78 of shroud 76, the shroud's inner surface 78 surrounding the outer surface 82 of the barrel. Barrel 80 has a breech end 84 and a muzzle end 86 and defines a bore 88 extending therebetween. Barrel 80 is movable relative to the shroud 76 along the line of action 74 between a forward position shown in FIG. 5 and a rearward position shown in FIG. 6. Motion of barrel 80 along line of action 74 is limited by various stops as described above.

Figure 6:
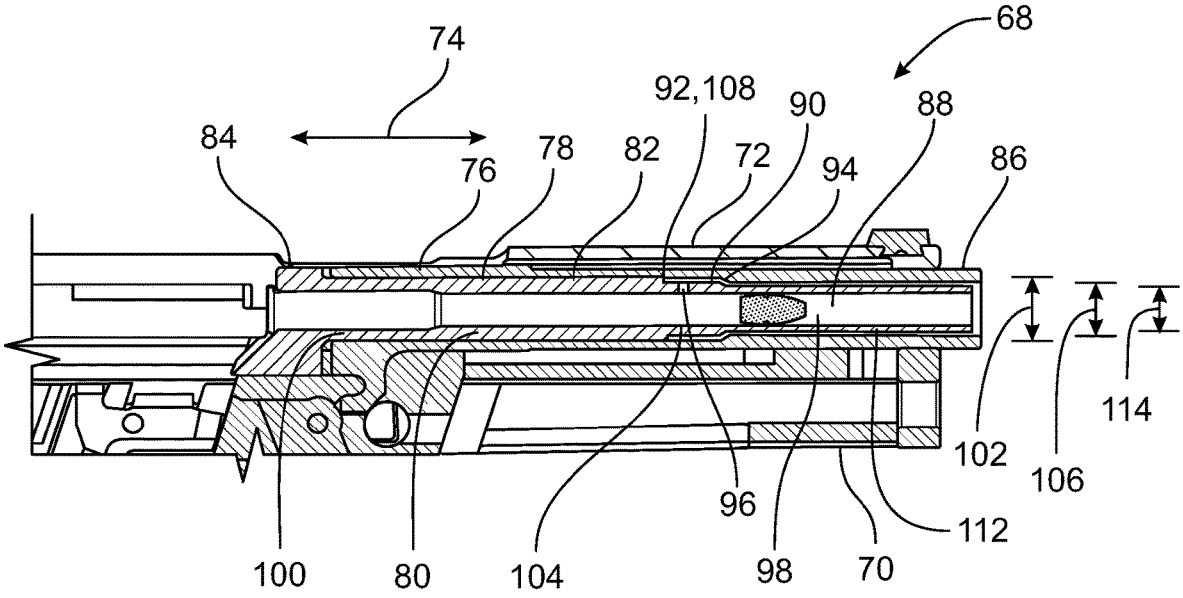
FIG. 6 is a partial sectional side view of the firearm embodiment shown in FIG. 5.
Figure 7:
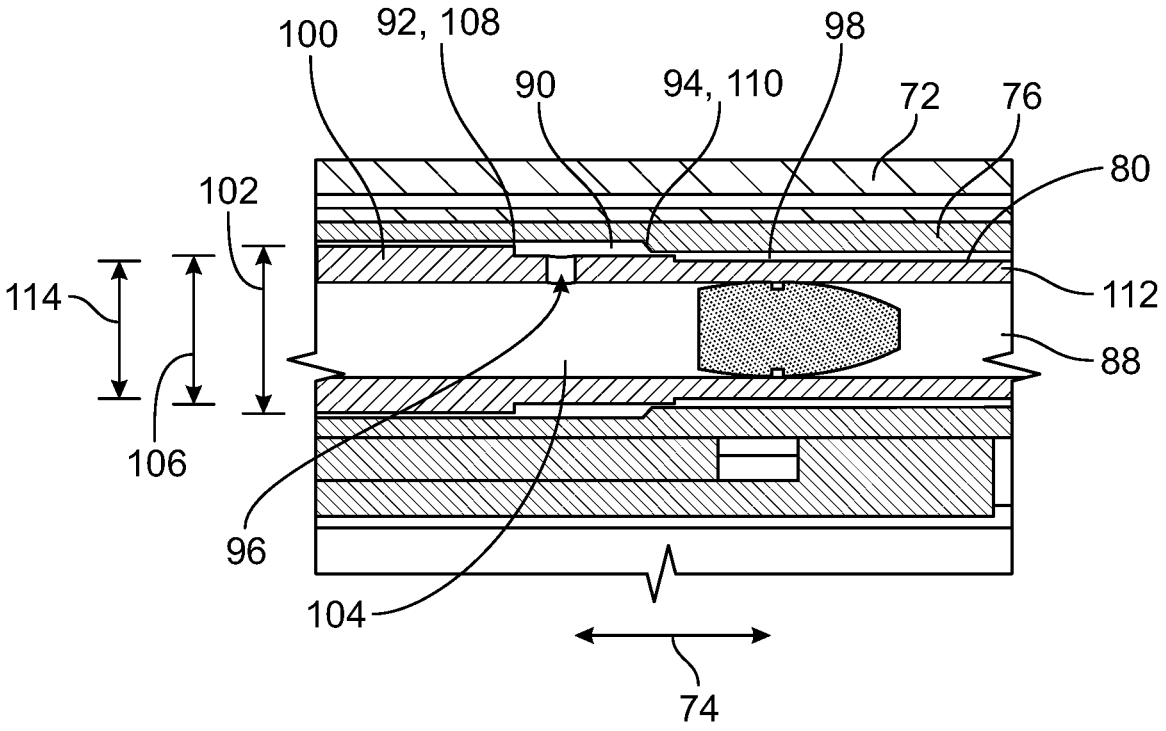
FIG. 7 is a partial sectional side view of a portion of the firearm shown in FIG. 5 on an enlarged scale.

As shown in FIGS. 5, 6 and 7, a gas space 90 is defined between the shroud 76 and the barrel 80. Gas space 90 is bordered by a thrust surface 92 positioned on the barrel 80 and a reaction surface 94 positioned on the shroud 76. Both the thrust surface 92 and the reaction surface 94 are oriented transversely to the line of action 74 and face the gas space 90. At least one gas port 96 extends through the barrel 80 between the bore 88 and the gas space 90 and provides fluid communication therebetween. Although a single gas port 96 is shown in this example, additional gas ports 96 may also be employed as required for a specific design. A gas vent 98 is positioned between the barrel 80 and the shroud 76 for discharging gas to atmosphere. As shown in FIG. 6, the gas vent 98 is in fluid communication with the gas space 90 when the barrel 80 is in the rearward position.

As shown in FIG. 7, the barrel 80 comprises a first portion 100 positioned between the breech end 84 and the muzzle end 86. First portion 100 of barrel 80 has a first outer diameter 102. A second barrel portion 104 is positioned between the first portion 100 and the muzzle end 86. The second portion 104 has a second outer diameter 106 smaller than the first outer diameter 102, the gas space 90 being defined between the shroud 76 and the second portion 104 of the barrel 80. The thrust surface 92 comprises a first annular surface 108 positioned on the barrel 80 between the first and second portions 100, 104. The reaction surface 94 comprises a second annular surface 110 positioned on the shroud 76 overlying the second portion 104 of the barrel 80. Barrel 80 further comprises a third portion 112 extending between the second portion 104 and the muzzle end 86. The third portion 112 of barrel 80 has a third outer diameter 114 less than the second outer diameter 106 of second barrel portion 104 and thereby defining the gas vent 98 between the barrel 80 and the shroud 76 for discharging gas to atmosphere.

Operation of an example firearm according to the invention is described for embodiment 10 with reference to FIGS. 1-4, the operation of embodiment 68 being similar.

As shown in FIG. 1, firearm 10 is ready to fire. A live cartridge 116 is chambered and slide 14 is in battery, with its breech block 118 engaged with the breech end 26 of barrel 22. Barrel 22 is in the forward position wherein its forward engagement surface 36 engages the forward stop surface 32 on shroud 18.

Figure 3:
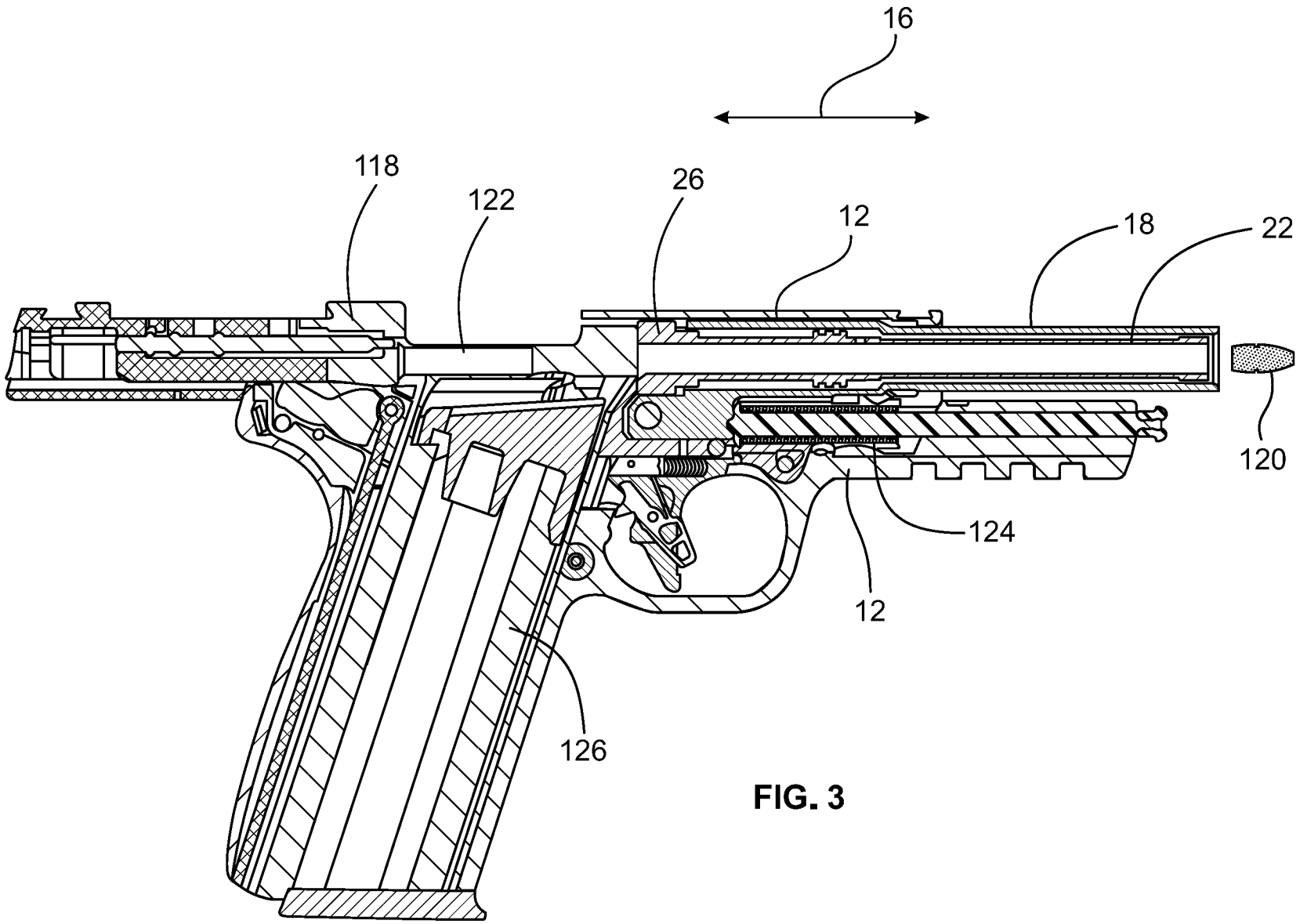
FIG. 3 is a sectional side view of the firearm shown in FIG. 1.

FIG. 2 shows the firearm just after cartridge 116 has been discharged, with the projectile 120 traversing the bore 30 of barrel 22 and having passed gas port 46. Propellant gas under pressure within bore 30 enters the gas space 40 through the gas port 46 and acts against the thrust surface 42 on the first shoulder 48 of the movable barrel 22 as well as the reaction surface 44 of the shroud 18, fixed to the frame 12. Pressure within the gas space 40 causes the barrel 22 to act as a piston and move along line of action 16 to the rearward position (to the left in FIG. 2) while propellant gas pressure within the bore 30 acts on the cartridge casing 122. Casing 122 may also act as a piston (depending upon the degree of friction between the casing and the chamber) and may also apply force to the breech block 118 along with force applied by the barrel 22. In reaction the slide 14 begins to move out of battery (to the left in FIG. 2). As this is a blowback action firearm, only the inertial mass of the slide 14 plus its breech block 118 and the force of return spring 124 keep the breech block and breech end 26 of the barrel 22 in engagement. Second shoulders 50 help seal the space between the shroud 18 and the barrel 22 and guide the barrel in its motion to the rearward position. With motion of barrel 22 to the rearward position the reaction surface 44 no longer seals the gas space 40 and fluid communication between the gas space 40 and the gas vent 60 is established allowing propellant gas to vent to atmosphere at the muzzle end 28 of the barrel. As shown in FIG. 4, gas is permitted to vent to atmosphere between the shroud 18 and the flat surfaces 64 positioned at the muzzle end 28 while the barrel is supported by engagement of the curved surfaces 66 with the shroud 18. With reference again to FIG. 2, motion of barrel 22 is halted as the rearward engagement surface 38 of barrel 22 engage the rearward stop surface 34 fixed to frame 12. However, as shown in FIG. 3, the slide 12 is still free to move along line of action 16. Propelled by the impulse of the cartridge casing 122 and the breech end 26 of the barrel 22 acting on the breech block 118 the slide 12 continues to move out of battery, extracting and ejecting spent casing 122 while compressing the return spring 124 acting between the slide and the frame 12. Once the slide 14 has completed its motion out of battery the return spring 124 acts, releasing its stored energy to drive the slide back into battery and strip and chamber another cartridge from the magazine 126 as shown in FIG. 1.

It is expected that blowback action firearms will benefit in reliability when the forces driving the action are augmented by propellant gas pressure tapped from the barrel bore.

What is claimed is:

1. A firearm, said firearm comprising:

a frame;

a slide mounted on said frame and movable relatively thereto along a line of action into and out of battery;

a shroud fixedly mounted on said frame between said slide and said frame;

a forward stop surface fixedly mounted relatively to said frame;

a rearward stop surface fixedly mounted relatively to said frame;

a barrel mounted within said shroud, said barrel having a breech end and a muzzle end and defining a bore extending therebetween, said barrel being movable relative to said shroud along said line of action between a forward position and a rearward position;

a forward engagement surface mounted on said barrel, said forward engagement surface being engageable with said forward stop surface when said barrel is in said forward position;

a rearward engagement surface mounted on said barrel, said rearward engagement surface being engageable with said rearward stop surface when said barrel is in said rearward position;

a gas space defined between said shroud and said barrel;

a thrust surface on said barrel oriented transversely to said line of action and facing said gas space;

a reaction surface on said shroud oriented transversely to said line of action and facing said gas space; and at least one gas port within said barrel extending between said bore and said gas space.

2. The firearm according to claim 1, wherein said forward stop surface is positioned on said shroud.

3. The firearm according to claim 1, wherein said rearward stop surface is positioned on said frame.

4. The firearm according to claim 1, wherein said forward engagement surface is positioned proximate said breech end of said barrel.

5. The firearm according to claim 1, wherein said rearward engagement surface is positioned proximate said breech end of said barrel.

6. The firearm according to claim 1, further comprising a gas vent positioned between said barrel and said shroud for discharging gas to atmosphere, said gas vent being in fluid communication with said gas space when said barrel is in said rearward position.

7. The firearm according to claim 1, wherein said shroud comprises an inner surface surrounding said barrel and said barrel comprises an outer surface facing said inner surface.

8. The firearm according to claim 7, wherein said inner and said outer surfaces are cylindrical.

9. The firearm according to claim 8, wherein said barrel comprises:

a first portion positioned between said breech end and said muzzle end, said first portion having a first outer diameter;

a second portion positioned between said first portion and said muzzle end, said second portion having a second outer diameter smaller than said first outer diameter, said gas space being defined between said shroud and said second portion of said barrel.

10. The firearm according to claim 9, wherein said thrust surface comprises a first annular surface positioned on said barrel between said first and second portions thereof.

11. The firearm according to claim 10, wherein said reaction surface comprises a second annular surface positioned on said shroud overlying said second portion of said barrel.

12. The firearm according to claim 9, wherein said barrel comprises a third portion extending between said second portion and said muzzle end thereof, said third portion having a third outer diameter less than said second outer diameter and thereby defining a gas vent between said barrel and said shroud for discharging gas to atmosphere.

13. The firearm according to claim 12, wherein said gas vent is in fluid communication with said gas space when said barrel is in said rearward position.

14. The firearm according to claim 8, further comprising a first shoulder projecting from and extending around said barrel, said first shoulder being positioned proximate to said at least one gas port and comprising said thrust surface.

15. The firearm according to claim 14, further comprising a second shoulder projecting from and extending around said barrel, said second shoulder being positioned in spaced relation to said first shoulder, said first shoulder being positioned between said second shoulder and said at least one gas port.

16. The firearm according to claim 14, further comprising a plurality of second shoulders projecting from and extending around said barrel, said second shoulders being positioned in spaced relation to one another and to said first shoulder, said first shoulder being positioned between said second shoulders and said at least one gas port.

17. The firearm according to claim 14, wherein a portion of said barrel between said at least one gas port and said muzzle end has a first outer diameter and a second portion of said barrel between said first portion and said muzzle end has a second outer diameter less than said first portion and thereby defining a gas vent between said barrel and said shroud for discharging gas to atmosphere.

18. The firearm according to claim 17, wherein said gas vent is in fluid communication with said gas space when said barrel is in said rearward position.

19. The firearm according to claim 1, wherein a portion of said barrel proximate said muzzle end comprises a plurality of flat outer surfaces positioned circumferentially around said barrel.

20. The firearm according to claim 19, further comprising a plurality of curved surfaces, each said curved surface positioned between two of said flat surfaces, said curved surfaces being engageable with said shroud.

21. The firearm according to claim 1, wherein said firearm comprises a pistol.

* * * * *